US006340964B1

(12) United States Patent
Nakazawa et al.

(10) Patent No.: US 6,340,964 B1
(45) Date of Patent: Jan. 22, 2002

(54) DRIVING DEVICE AND LIQUID CRYSTAL DISPLAY DEVICE

(75) Inventors: Akira Nakazawa; Masakazu Kitamura; Kiyoshi Tamai; Makoto Nagai, all of Kanagawa (JP)

(73) Assignee: Optrex Corporation, Tokyo (JP)

( * ) Notice: Subject to any disclaimer, the term of this patent is extended or adjusted under 35 U.S.C. 154(b) by 0 days.

(21) Appl. No.: 09/409,394

(22) Filed: Sep. 30, 1999

(30) Foreign Application Priority Data

Sep. 30, 1998 (JP) ..... 10-278503

(51) Int. Cl.[7] ..... G09G 3/36
(52) U.S. Cl. ..... 345/100
(58) Field of Search ..... 345/94, 95, 100

(56) References Cited

U.S. PATENT DOCUMENTS 5,262,881 A * 11/1993 Kuwata et al. ..... 345/93
5,420,604 A * 5/1995 Scheffer et al. ..... 345/100
5,459,495 A * 10/1995 Scheffer et al. ..... 345/147
5,475,397 A * 12/1995 Saidi ..... 345/95
5,481,651 A * 1/1996 Herold ..... 345/94
5,485,173 A * 1/1996 Scheffer et al. ..... 345/100
5,546,102 A * 8/1996 Scheffer et al. ..... 345/100

* cited by examiner

*Primary Examiner*—Amare Mengistu
(74) *Attorney, Agent, or Firm*—Oblon, Spivak, McClelland, Maier & Neustadt, P.C.

(57) ABSTRACT

Presented is a driving device 301 for a liquid crystal panel 10, which is provided with a controller 1, a memory 2, a row selection pattern generating circuit 7, a row voltage generating circuit 9, a latch circuit 6B, a column voltage generating circuit 11 and an operating circuit 51 (a line buffer group 3, a comparator circuit 4, adder circuits 5A, 5B, a latch circuit 6A and an imaginary data generating circuit 8), wherein an orthogonal matrix B of 6 simultaneously selected rows and 2 imaginary rows which is formed by expanding an orthogonal matrix A of 4 rows is used for a row selection pattern, and column output voltages are operated with a unit of A.

20 Claims, 12 Drawing Sheets

FIG. 3

$$A = \begin{array}{c} \begin{pmatrix} -1 & 1 & 1 & 1 \\ 1 & -1 & 1 & 1 \\ 1 & 1 & -1 & 1 \\ 1 & 1 & 1 & -1 \end{pmatrix} \end{array} \begin{array}{l} L1 \\ L2 \\ L3 \\ D1 \end{array}$$

FIG. 4

$$\begin{pmatrix} B \end{pmatrix} = \begin{pmatrix} A & A \\ A & -A \end{pmatrix} = \begin{pmatrix} -1 & 1 & 1 & 1 & -1 & 1 & 1 & 1 \\ 1 & -1 & 1 & 1 & 1 & -1 & 1 & 1 \\ 1 & 1 & -1 & 1 & 1 & 1 & -1 & 1 \\ 1 & 1 & 1 & -1 & 1 & 1 & 1 & -1 \\ -1 & 1 & 1 & 1 & 1 & -1 & -1 & -1 \\ 1 & -1 & 1 & 1 & -1 & 1 & -1 & -1 \\ 1 & 1 & -1 & 1 & -1 & -1 & 1 & -1 \\ 1 & 1 & 1 & -1 & -1 & -1 & -1 & 1 \end{pmatrix} \begin{array}{l} L1 \\ L2 \\ L3 \\ D1 \\ L4 \\ L5 \\ L6 \\ D2 \end{array}$$

$$\begin{pmatrix} 1 & 1 & 1 & 1 & 1 & 1 & 1 & 1 \\ 1 & -1 & 1 & -1 & 1 & -1 & 1 & -1 \\ 1 & 1 & -1 & -1 & 1 & 1 & -1 & -1 \\ 1 & -1 & -1 & 1 & 1 & -1 & -1 & 1 \\ 1 & 1 & 1 & 1 & -1 & -1 & -1 & -1 \\ 1 & -1 & 1 & -1 & -1 & 1 & -1 & 1 \\ 1 & 1 & -1 & -1 & -1 & -1 & 1 & 1 \\ 1 & -1 & -1 & 1 & -1 & 1 & 1 & -1 \end{pmatrix}$$

FIG. 12

D1 1
D2 1
D3 1
D4 1
D5 1

FIG. 13

D1 0
D2 0
D3 0
D4 0
D5 1

DRIVING DEVICE AND LIQUID CRYSTAL DISPLAY DEVICE

BACKGROUND OF THE INVENTION

1. FIELD OF THE INVENTION

The present invention relates to a driving device and a liquid crystal display device which are suited for a simple matrix type liquid crystal display element to be driven by a driving method in which a plurality of lines are simultaneously selected.

2. DISCUSSION OF BACKGROUND

Conventionally, as driving methods for a simple matrix liquid crystal display device, there are a driving method based mainly on a so-called line successive driving system (a conventional Example 1) and a multiple line simultaneously selecting/driving method in which row electrodes are simultaneously selected or a multiple line addressing method (hereinbelow, referring to as a MLA driving method) (a conventional Example 2).

The conventional Example 1 is a driving method in which scanning voltages are successively applied to each row electrode, and at the same time, column voltages are applied to a plurality of column electrodes whereby brightness controlling voltages are applied to each of the row electrodes. Further, display dots are controlled to have transmittances in response to average effective voltages applied during a time in which the voltages are once applied to all the row electrodes (hereinbelow, referred to as a frame period). A predetermined picture image is displayed for each frame period.

The conventional Example 2 is a driving method as follows. All the row electrodes constituting a display surface area are divided into simultaneously selected groups each comprising a plurality of row electrodes, and scanning voltages are simultaneously applied to each of the row electrodes of the simultaneously selected groups. Further, column voltages are applied to a plurality of column electrodes at the same time of the application of the scanning voltages so that selection voltages are applied to a plurality of liquid crystal pixels to which the column voltages are simultaneously applied. The above-mentioned operation is repeated at least the same number of times as the simultaneously selected number of row electrodes.

As a result, the display dots are controlled to have transmittances in response to average effective voltages applied during a time in which the above-mentioned repeated operations complete (1 frame period), and a picture image is formed for each frame period.

In this conventional Example 2, the column voltages applied to column electrodes are voltages obtained by multiplying "a unit column voltage" with values determined by performing matrix operations of display data corresponding to a plurality of simultaneously selected row electrodes and a scanning voltage applied to the simultaneously selected row electrodes.

The maximum value of magnifying power obtained by the matrix operations suffers restriction by an orthogonal matrix for the scanning voltage used for the matrix operations. It takes at most a larger value between the number of rows or the number of columns in the matrix. As examples of the conventional Example 2, there are JP-A-6-27907, U.S. Pat. No. 5,262,881, JP-A-8-234164 and so on.

The above-mentioned liquid crystal display device has been used as a display device for a man-machine interface with the progress of highly intelligent society. In recent years, it is widely used not only for a desktop type personal computer but also for a notebook type personal computer, PDA (a portable information terminal) or a portable telephone, which is suitable for carrying, taking an advantage of thin and light in weight. As a result, in the development of the liquid crystal display device, improvement has been made to provide a large surface area, and on the other hand, improvements of reducing the weight and power consumption rate have been made.

In such liquid crystal display device, various measures have been taken to lower the power consumption rate. In more detail, there are measures to form a liquid crystal display element capable of responding to a low effective voltage, or to use a reflective type liquid crystal display element without requiring a backlight.

Further, as a conventional Example 3, there is a publication "general-purpose addressing technology for an effective value response type liquid crystal display device (a report of SID meeting 1988, p. 80–p.85)" which reports the relation between the MLA driving method and consumption power. The conditions indicated by the conventional Example 3 are "$L=\sqrt{M}$ (provided M represents the total number of row electrodes for a display picture surface and L represents a number of simultaneously selected rows)", and the optimum bias ratio at which a ratio of an effective voltage at an ON display time to an effective voltage at an OFF display time becomes the maximum ($B_{best}$=maximum column voltage/scanning voltage=VC/VR). The publication reports that when the MLA driving was conducted under the above-mentioned conditions, a driving voltage for the liquid crystal display device can be reduced in comparison with that by a line successive driving method.

In JP-A-9-277650, when $L\neq\sqrt{M}$ and the MLA driving is conducted under a condition other than using the optimum bias ratio, the ratio of an effective voltage at an ON display time to an effective voltage at an OFF display time does not show the maximum value. However, it is possible to set a supplied voltage to be lower. Further, in a case of producing a one-chip LSI capable of carrying out multiplex driving at a duty ratio of about 1/80, it was possible to integrate a driving circuit by a semiconductor manufacturing process for a 5-V standard logic IC. Further, capability of not only low consumption power but also reduction of manufacturing cost was shown (a conventional Example 4). On the other hand, for reducing power consumption rate by contriving a circuit structure, there is a method of lowering a clock frequency and conducting a parallel treatment.

Operations of the conventional Example 1 will be described with reference to FIGS. 7 and 11. FIG. 7 is a block diagram showing a controller-attached driving device 201 for driving a "64 row×132 column"-dot matrix type liquid crystal display element.

Interface signals I/F are inputted from an outer source to a controller 1. Row address signals ADRS and a read/write signal R/W are supplied from the controller 1 to a memory 2. Data DATA are supplied from an outer source to the memory 2.

RAMs for display data are built in the memory 2, and 1 dot in the built-in RAM corresponds to 1 dot in the liquid crystal panel in a one-to-one relation. The memory 2 decodes the row address signals ADRS from the controller 1 to output in parallel data (1 bit*132) for 1 row corresponding to the address signals, the outputted data being latched in line buffers 3 in synchronism with a clock.

A column voltage generating circuit 11 decodes display data (1 bit*132) from the line buffers 3 and a signal, for providing an alternate current to liquid crystal, i.e., a polarity inversion signal POL-CHG, supplied from the controller 1, and the decoded signals are supplied to a level shifter in which column voltages are suitably selected among levels of "V0, V2, V3, V5". The selected column voltages are outputted to the liquid crystal panel 10 in synchronism with a clock CLK.

When rows are sequentially selected in a form of shift register in synchronism with the clock CLK, a row voltage generating circuit 9 decodes the polarity inversion signals POL-CHG and a value of register indicating selection or non-selection, and the decoded signals are supplied to a level shifter in which row voltages are formed suitably among "V0, V1, V4, V5", the formed row voltages being outputted to the liquid crystal panel 10. In this case, when the row voltage generating circuit 9 selects then throw, synchronization is taken so that the column voltage generating circuit 11 outputs column voltages as data corresponding to the n th row in RAM.

Driving waveforms in a driving state are shown in FIG. 11. After a change of the polarity inversion signal POL-CHG (the Figure shows a state that there is a change from low to high), an alternate current which oscillates at both side with respect to the center of "V2, V3" levels is formed for each of a row output and a column output in synchronism with the clock CLK (a row waveform RW and a column waveform CW). Thus, under conditions of the multiplex driving and a low duty ratio, the method for treating in parallel all column signal data is used.

Operations of the conventional Example 2 will be described with reference to FIGS. 8 and 10. FIG. 8 is a block diagram of a controller-attached driving device 202 for a "64 row×132 column"-dot matrix type liquid crystal display element in which the number of simultaneously selected/driven rows is a and the number of imaginary rows is b. FIG. 10 shows an operational timing for each circuit.

In FIG. 8, the memory 2, in the same manner as in the line successive driving method, decodes row address signals ADRS from a controller 1 to output in parallel data for 1 row (1 bit*132), and outputted data are latched in a line buffer group 3 in synchronism with a clock CL1.

Values of address signals from the controller 1 are increased in synchronism with CL1. The same operations are repeated a times so that data for a rows are held in the line buffer group 3. D1, D2, . . . Da in FIG. 10 show data latched by line buffers 3 for each row of the first, the second, . . . the a throws respectively.

When data for a rows are stored, predetermined operations are conducted on the stored data and row selection pattern signals supplied from a row selection pattern generating circuit 7, and signals produced as a result of the operations are latched by a latch circuit 6 in synchronism with a clock CL2. A relation of timings of operation periods, latch data, clock CL1 and clock CL2 are shown in FIG. 10.

In FIG. 10, symbols CL1, CL2, LB1, LB2, LBa, RS, OT, $L_{DATA}$, and R/C-Vout indicate respectively clock 1, clock 2, line buffer 1, line buffer 2, line buffer a, row selection signal, operation period, latch data and row/column voltage outputs.

As the row selection signal RS, 5 patterns of PAT-1 to PAT-5 are produced. The latch data $L_{DATA}$ hold a result of operations as OP-D1 to OP-D4 in order. Then, voltages are outputted to rows and columns (OUT1 to OUT3).

An operating circuit 52 shown in FIG. 8 executes, about data for a rows outputted from the line buffer group 3, imaginary data for b rows outputted from an imaginary data generating circuit 8 and a row selection pattern for (a+b) rows, an exclusive OR operation for each bit as shown in FIG. 6, to conduct operations to add (a+b) outputs.

In FIG. 6, there are inputs of a line buffer output LBout, a row selection pattern R-Spat and an imaginary data output P-Dout, and a result of operations is outputted to outputs 1 to a+b (out1 to outa+b). These operations are conducted in parallel to a 132 number of column signals. A result of operations outputted from the latch circuit 6 is supplied to a column voltage generating circuit 11. c-bit data supplied to the column voltage generating circuit 11 are passed through a decoder and a level shifter to be outputted as column voltages. In this case, for the c-bit data as a result of operations, there are considered (a+b+1) ways of 0, 1, 2 . . . (a+b) in outputted values when an adder circuit having (a+b) inputs is used, and the c-bit data correspond to those of outputted values.

However, the number of outputted values can be reduced when imaginary data are selected suitably. Hereinbelow, explanation will be made as to a method for adjusting bits in operations in a case of adding imaginary data and the imaginary data generating circuit 8 wherein 5 simultaneously selected rows and 3 imaginary rows are used.

FIG. 5 shows a "8×8, Hadamard's matrix. 5 Bits in an upper place are for a matrix for rows to be actually selected and 3 bits in a lower place are for a matrix for imaginary rows. Here, a 5-row simultaneously selecting driving method without providing any imaginary row is considered. For example, in the data as shown in FIG. 12, when exclusive OR operations are executed for each bit in a "5×8" matrix, values as a result of adding are "0, 2, 2, 2, 1, 3, 3, 3" for each column.

Further, in the data as shown in FIG. 13, values of "4, 2, 2, 2, 5, 3, 3, 3" are provided. In consideration of all other data, there are 6 ways of 0, 1, 2, 3, 4, 5" as obtainable values. Namely, levels for column outputs are 6.

Assuming that "1" is at the 6 th row, "0" at the 7 th row, and "0" at the 8 th row in the data of FIG. 12, and the same operations as for the "8×8" matrix in FIG. 5 are conducted. Then, outputs for each column are "2, 4, 2, 4, 2, 4, 6, 4". Further, assuming that "0" at the 6 th row, "0" at the 7 th row and "1" at the 8 th row in the case of FIG. 13, and when the same operation as above-mentioned are conducted, outputted values are "6, 4, 4, 2, 6, 4, 4, 6".

It is understood that when appropriate imaginary data are considered with respect to all 6-bit data, output values can be summarized to 3 ways of "2, 4, 6". This can be considered as mentioned below.

As described above, output values in a case without providing any imaginary row are 6 ways of "0, 1, 2, 3, 4, 5". However, output values can be changed in any value of "0, +1, +2 or +3," when data for 3 rows as imaginary rows are provided. Accordingly, when an output value is 0 in a case without providing any imaginary row, it can be changed "2". Similarly, it is possible to change an output value 1 to "2" or "4", an output value of 2 to "2" or "4", an output value of 3 to "4" or "6", an output value of 4 to "4" or "6" and an output value of 5 to "6". As a result, summarization to 3 ways of "2, 4, 6" can be made.

Based on these rules, the imaginary data generating circuit 8 can properly determine imaginary data with use of a a-bit decoder, a look-up table or the like. Thus, the effective bit number of outputs from the adder circuit 5 can be reduced with the data outputted from the imaginary data generating circuit 8. The row voltage generating circuit 9 decodes row selection signals outputted from the row selection signal generating circuit to apply row voltages to an a number of selected rows selected sequentially in a form of shift register. Output timings on row voltages and column voltages are shown in FIG. 10.

In the technique of the conventional Example 2, however, there were problems as follows because the driving device for determining imaginary rows to be driven comprised circuit blocks as described above.

Namely, when column signals were treated in parallel, a column voltage operating circuit, line buffers and an imaginary data generating circuit were required in comparison with the driving device of the conventional Example 1, for which the line successive driving method was used. Accordingly, the scale of circuit was increased and the surface area of a chip was increased. In an attempt to form the driving device in a form of a one-chip LSI, although a semiconductor manufacturing process for a 5-V standard logic IC could be utilized, cost for manufacturing was finally increased.

Further, when a clock speed was increased in order to suppress an increase of the circuit scale, a current to be consumed was increased. Thus, the circuit scale and the current to be consumed were in a relation of tradeoff. The present invention is to provide a driving device for a MLA driving method wherein the circuit structure is optimized and an increase of the circuit scale can be suppressed in a case of forming an integration circuit while an increase of a current to be consumed is minimized.

SUMMARY OF THE INVENTION

In accordance with an embodiment 1 of the present invention, there is provided a driving device comprising an imaginary data generating means, a row electrode driving means, a column electrode driving means, a memory means for memorizing display data, an operating means for operating column output voltages and a row selection pattern generating means for outputting a row selection pattern wherein a k·m number (k is an integer of not less than 2 and m is an integer of not less than 1) of simultaneously selected/driven rows and a k·n number (n is an integer of not less than 1) of imaginary row are determined for a liquid crystal display element comprising row electrodes and column electrodes arranged in a matrix form and the display element is driven by a MLA driving method, the driving device being characterized in that a matrix B is used for a row selection pattern, which is formed by expanding a matrix A of (m+n) rows where row vectors perpendicularly intersect each other, and column output voltages are operated with a unit of A.

Further, according to an embodiment 2, there is provided a driving device comprising a row electrode driving means, a column electrode driving means, a memory means for memorizing display data, an operating means for operating column output voltages and a row selection pattern generating means for outputting a row selection pattern wherein a k·m number (k is an integer of not less than 2 and m is an integer of not less than 1) of simultaneously selected/driven rows and k rows of imaginary row are determined for a liquid crystal display element comprising row electrodes and column electrodes arranged in a matrix form and the display element is driven by a MLA driving method, the driving device being characterized in that a matrix B is used for a row selection pattern, which is formed by expanding a matrix A of (m rows+1 imaginary row) where row vectors perpendicularly intersect each other, and column output voltages are operated with a unit of A.

Further, as an embodiment 3, there is provided the driving device according to the embodiment 1 or the embodiment 2, wherein the matrix B in which row vectors perpendicularly intersect each other is used, provided that in the below-mentioned formula (1), $P_1$, $P_2$, $P_3$ and $p_4$ are respectively 1 or −1, and $P_1 \cdot P_2 \cdot P_3 \cdot P_4 = -1$:

$$B = \begin{bmatrix} p_1 \cdot A & p_2 \cdot A \\ p_3 \cdot A & p_4 \cdot A \end{bmatrix}. \quad (1)$$

Further, according to an embodiment 4, there is provided the driving device according to the embodiment 3, wherein a matrix C in which row vectors perpendicularly intersect each other is used, provided that in the below-mentioned formula (2), $P_5$, $P_6$, $P_7$ and $P_8$ are respectively 1 or −1, and $P_5 \cdot P_6 \cdot P_7 \cdot P_8 = -1$:

$$C = \begin{bmatrix} p_5 \cdot B & p_6 \cdot B \\ p_7 \cdot B & p_8 \cdot B \end{bmatrix}. \quad (2)$$

Further, there is provided the above-mentioned driving devices, wherein the rows and/or the columns in the matrix B or the matrix C are exchanged. Further, there is provided the above-mentioned driving devices wherein signs on columns in the matrix B or the matrix C are reversed. Further, there is provided the above-mentioned driving devices wherein k=2 and m=3. Further, there is provided the above-mentioned driving devices wherein K=2, m=3 and n=1.

Further, as an embodiment 5, there is provided the driving device as described in the embodiment 1, 2, 3 or 4 wherein the device is in a one-chip LSI. In this case, it is preferable that an oscillating circuit and a power source circuit are built in.

Further, as an embodiment 6, there is provided a liquid crystal display device provided with the driving device as described in the embodiment 1, 2, 3, 4 or 5 and liquid crystal display element.

BRIEF DESCRIPTION OF THE DRAWINGS

FIG. 3 shows a "4×4" orthogonal matrix;

FIG. 4 shows an orthogonal matrix obtained by expanding, which is used for a row selection pattern generating circuit for the present invention (Example 1);

FIG. 12 shows an example of display data in the present invention;

FIG. 13 shows an example of display data in the present invention;

In the following, description will be made as to each Example with reference to the drawings. Examples 1 and 2 concern the present invention and Example A concerns a Comparative Example.

EXAMPLE 1

Figure 1:
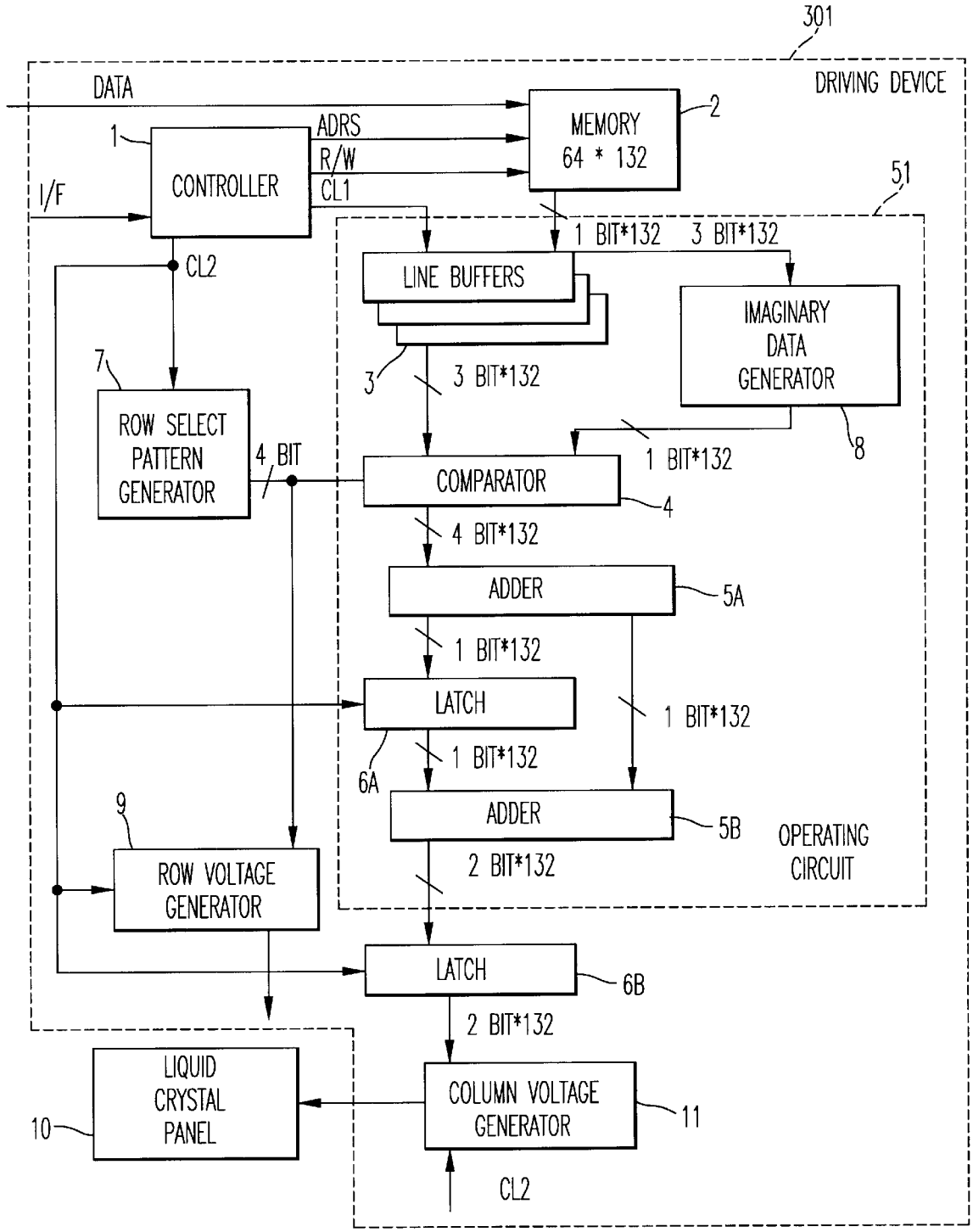
FIG. 1 is a block diagram of a driving device according to the present invention (Example 1)

FIG. 1 is a block diagram showing the construction of Example 1. A driving device 301 is provided with an operating circuit 51 which comprises a line buffer group 3, a comparator circuit 4, an adder circuit 5A, a latch circuit 6A, an adder circuit 5B and an imaginary data generating circuit 8, a row selection pattern generating circuit 7, a row voltage generating circuit 9, a controller 1, a memory 2, a latch circuit 6B and a column voltage generating circuit 11, to drive a liquid crystal panel 10.

In this Example, a liquid crystal panel 10 having a "64 line×132 column"-dot simple matrix liquid crystal display element in which a simple matrix driving is conducted, is used. In this liquid crystal panel 10, the number of simultaneously selected row electrodes was 6 (k=2, m=3) and the number of imaginary row electrodes was 2 (k=2, n=1).

The driving device 301 for the liquid crystal panel is provided with the controller 1 for controlling an interface to MPU and a timing on each inner unit, the memory 2 in which display data are written, the operating circuit 51 for determining voltages to be applied to column electrodes, the row selection pattern generating circuit 7 for generating a pattern for determining column voltages, i.e., a row selection pattern applied to row electrodes in response to operations to display data, the row voltage generating circuit 9 for generating row voltages according to the row selection pattern, and the column voltage generating circuit 11 for generating column voltages depending on outputs from the operating circuit 51.

In the operating circuit 51, there are provided the line buffer group 3, the imaginary data generating circuit 8, the comparator circuit 4, the adder circuit 5A, the latch circuit 6A and the adder circuit 5B. Further, the output of the adder circuit 5B is connected to the latch circuit 6B, and the output of the latch circuit 6B is connected to the column voltage generating circuit 11. Connections of each of the units are as follows.

Data are inputted from an outer source to the memory 2. Interface signals I/F are inputted from an outer source to the controller 1. Row address signals ADRS and a read/write signal R/W are supplied from the controller 1 to the memory 2. A clock CL1 is supplied from the controller 1 to the line buffer group 3. A clock signal CL2 is supplied from the controller 1 to the row selection pattern generating circuit 7, the latch circuit 6A, the row voltage generating circuit 9, the column voltage generating circuit 11 and the latch circuit 6B.

A 1-bit*132 signal is supplied from the memory 2 to the line buffer group 3. A 3-bit*132 signal is supplied from the line buffer group 3 to the imaginary data generating circuit 8. Further, a 3-bit*132 signal is supplied from the line buffer group 3 to the comparator circuit 4. A 1-bit*132 signal is supplied from the imaginary data generating circuit 8 to the comparator circuit 4. A 4-bit signal is supplied from the row selection pattern generating circuit 7 to the comparator circuit 4 and the row voltage generating circuit 9.

A 4-bit*132 signal is supplied from the comparator circuit 4 to the adder circuit 5A. A 1-bit*132 signal is supplied from the adder circuit 5A to the latch circuit 6A. Further, a 1-bit*132 signal is supplied from the adder circuit 5A to the adder circuit 5B.

A 1-bit*132 signal is supplied from the latch circuit 6A to the adder circuit 5B. A 2-bit*132 signal is supplied from the adder circuit 5B to the latch circuit 6B. A 2-bit*132 signal is supplied from the latch circuit 6B to the column voltage generating circuit 11. Further, to the liquid crystal panel 10, column voltages are applied from the column voltage generating circuit 11 and row voltages are applied from the row voltage generating circuit 9.

Operations of each block will be described in detail. The controller 1 is adaptable to an interface for a 80 series parallel MPU or a 68 series parallel/serial MPU, and is adapted to store data, supplied from the interface, in the memory 2. A display RAM of 64×132 bits is built in the memory 2 wherein 1 dot in the built-in RAM corresponds to a pixel of 1 dot of the liquid crystal plane 11 in a one-to-one relation.

The memory 2 decodes values of line address signals supplied from the controller 1 to provide 132 numbers of data, which correspond to 1 line, to the line buffer group 3. Values of line address signals from the controller 1 are increased in synchronism with the clock CL1. Data for 1 row are sequentially supplied, as continuous row data, to the line buffer group 3, which are latched by the line buffer group 3 in synchronism with the clock CL1. The line buffer group 3 has a function to latch data for 3 rows, and holds data for 3 rows which are continuous in a form of shift register.

While the line buffer group 3 has the function of latching data for 3 rows in this example, a latching function of data for 2 rows is sufficient if synchronization can be taken well. For data for the third row, signals from the memory 2 can directly be inputted to the comparator circuit 4 and the imaginary data generating circuit 8.

Figure 2:
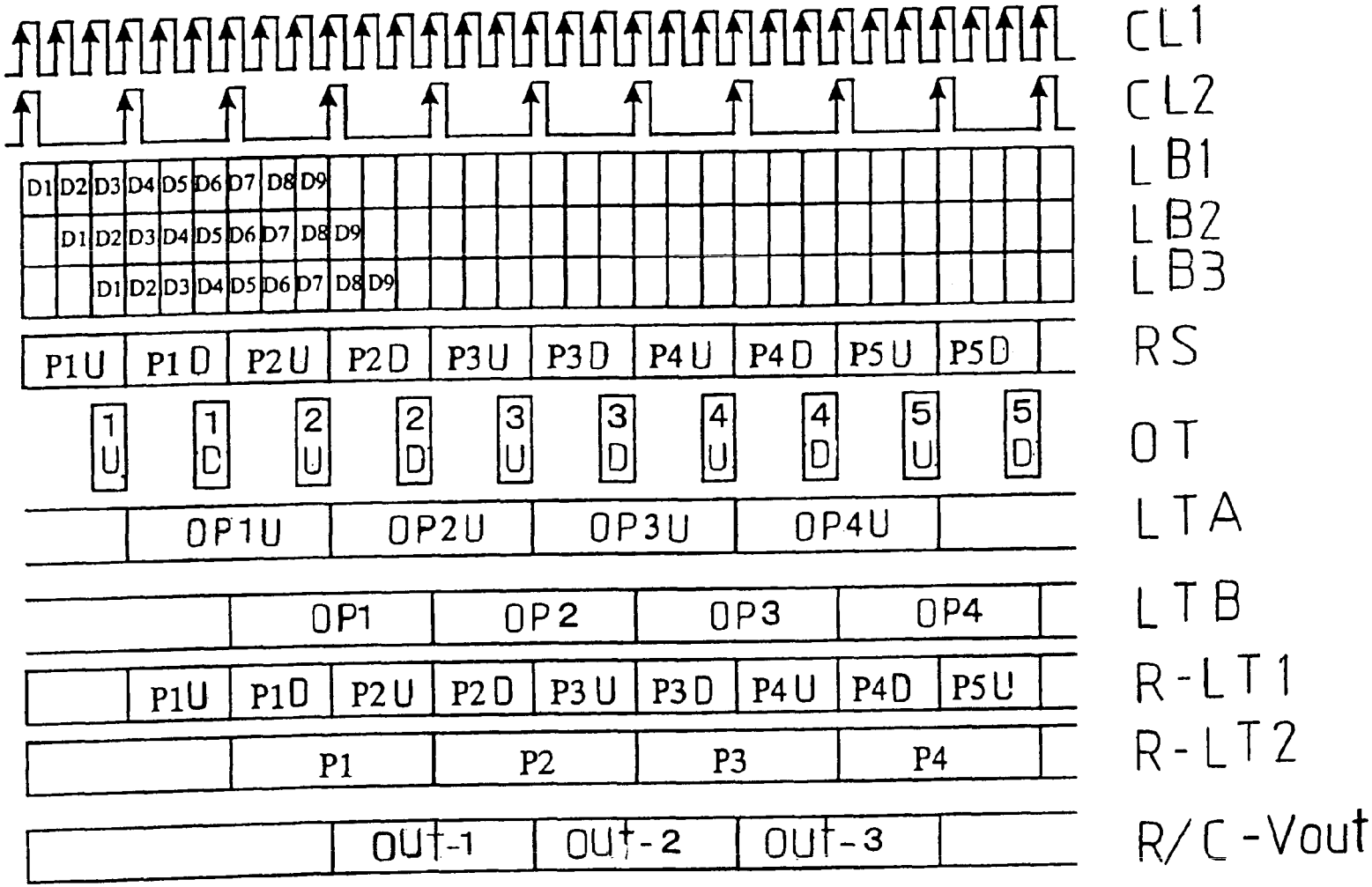
FIG. 2 is a diagram of timings for explaining operations of the present invention (Example 1)

On the other hand, the row selection pattern generating circuit 7 generates a 4-bit row selection pattern in synchronism with clock CL2 supplied from the controller 1. Clock CL2, as shown in FIG. 2, is a signal formed by combining 3 pulses of the clock CL1, and a row selection pattern is renewed each time when data for 3 rows in the line buffer group 3 are all renewed.

For the row selection pattern, an orthogonal matrix B of "8×8" as shown in FIG. 4 was used. The orthogonal matrix B is an orthogonal matrix, as shown in FIG. 4, obtained by expanding an orthogonal matrix A of "4×4" shown in FIG. 3. A row corresponding to the fourth row in the orthogonal matrix A in FIG. 3 was rendered to be an imaginary row electrode. The first to third rows correspond to actually existing rows (L1–L3) and the fourth row is an imaginary row (D1). In FIG. 4, L1–L6 correspond to actual rows and two rows (D1, D2) are imaginary rows.

Even in such expansion, orthogonality can be maintained. In the orthogonal matrix B of "8×8", 4 bits in an upper place and 4 bits in a lower place in columns are outputted in this order in synchronism with CL2 so that they are shifted sequentially in a direction of column.

Elements "1" and "−1" in the orthogonal matrix correspond respectively to signals indicating "1" and "0" as logic signals, and "1" represents a positive selection voltage and "−1" represents a negative selection voltage as voltages outputted finally to the liquid crystal panel 10.

A 4-bit row selection pattern outputted from the row selection pattern generating circuit 7 is supplied to the row voltage generating circuit 9 and the comparator circuit 4, and at the same time, 3 bits, which correspond to selected actual rows, among 4 bits are supplied to the row voltage generating circuit 9.

Data of 6 bits, i.e. two times of data of 3 bits in the signal supplied to the row voltage generating circuit 9 are converted into row voltages by means of a decoder and a level shifter, and the converted row voltages are outputted from 6 selected rows in synchronism with CL2.

In this case, 6 rows selected by the row voltage generating circuit 9 should be in synchronism with column voltage outputs operated based on data corresponding to the 6 rows. For this, timing matching is conducted to column signals by outputting signals at a timing as shown in FIG. 2. From an upper portion of a paper showing FIG. 2, CL1, CL2 LB1 (line buffer 1), LB2 (line buffer 2), LB3 (line buffer 3), RS (row selection signal), operation time (OT), latch A (LTA), latch B (LTB), R-LT1 (row signal latch 1), R-LT2 (row signal latch 2) and R/C-Vout (row/column voltage output) are shown sequentially.

"U" and "D" of PFU and P1D in the waveform of RS correspond respectively to "up" and "down". Symbols in the waveform of OT and in each of the waveforms of LT-A, R-LT1 are the same as above. OP represents a symbol indicating operation.

Rows are sequentially selected for each block comprising 6 rows as a unit by a shift register. After the eleventh block, i.e., "61, 62, 63, 64, 65 and 66 th rows" have been selected, selection of the first block, i.e., "1, 2, 3, 4, 5 and 6 th rows" is conducted, and operations are repeated.

In this case, the 65 and 66th rows are not in fact displayed, and they do not exist in the memory 2. However, since they are required for operations, an increment operation for addressed data in memory 2 is stopped, and the data for the 64th line are directly applied to the 65 and 66th lines. When all the blocks have selected once the orthogonal matrix B comprising 8 columns, 1 flame is completed.

On the other hand, for the row selection pattern supplied to the comparator circuit 4, data for 4 rows in total, i.e., data for 3 rows from the line buffer group 3 and data for 1 row from the imaginary data generating circuit 8 are operated for 132 columns, namely, data of 4×132 bits are operated.

The imaginary data generating circuit 8 is a device for generating imaginary data for 1 row from data for 3 rows, which is composed of a 3-bit decoder. The imaginary data generating circuit 8 functions to reduce column voltage levels as described above. For example, in a case of simultaneously selecting 3 rows, imaginary data are determined so that only 1 and 3 column voltage levels are taken from 4 column voltage levels of 0, 1, 2 and 3.

The comparator circuit 4 comprises a 4×132 number of exclusive OR circuits which are adapted to conduct in parallel an exclusive OR treatment for each bit of the 4-bit row selection pattern and data of 4 rows with respect to data of 132 columns. A result of operations is supplied to the adder circuit 5A. The adder circuit 5A comprises a 132 number of 4-input adders to add outputted values of 4 bits from the comparator circuit 4.

5 Ways of "0, 1, 2, 3, 4" can be considered as added values, however, as described above, the imaginary data are determined to take only "1" and "3" as outputted values. Accordingly, there are actually 2 ways, and only 1 bit as the second bit in a lower place in the added outputs is effective. Outputs from the adder circuit 5A are latched by the latch circuit 6A in synchronism with the clock CL2. Thus, data for 3 rows among data for 6 rows are treated first.

For the remaining 3 rows, operations can be conducted in the same manner as above. A 1-bit output is obtained from the adder circuit 5A. This output and 1-bit data held in the latch circuit 6A are added in the adder circuit 5B. As a result, 2-bit data of 3 ways of "0, 1, 2" are latched by the latch circuit 6B. Outputs from the latch circuit 6B are supplied to the column voltage generating circuit 11 in which the outputs are passed through a decoder and a level shifter circuit to be supplied to the liquid crystal panel 10 in synchronism with CL2 as well as synchronization to the before-mentioned row electrode generating circuit 9.

As in this Example, when the orthogonal matrix B of "8×8" is formed by expanding the orthogonal matrix A of "4×4", it is unnecessary to operate all 6 lines in parallel as shown in the below-mentioned Example A, but it is possible to operate 3 lines 2 times. Then, in the circuit structure, the number of latch circuits including line buffers can be reduced from 8×132 to 6×132. With respect to the comparator circuit 4, the 8×132 number of exclusive OR circuits is reduced to half as 4×132. A 8-bit adder circuit can be replaced by a 4-bit adder circuit and a 2-bit adder circuit, and a 6-bit decoder can be a 3-bit decoder. As a result, a drastic reduction of the number of circuits can be achieved in the driving device as a whole. Further, manufacture of a one-chip IC can be easy.

Operations can be conducted in the same manner as above even in a case that columns in the expanded matrix are changed, or signs on columns are changed. In a case of exchanging rows, operations can be conducted as follows in the same manner as above. Namely, a matrix without exchanging the rows can be used as it is by exchanging addressed values at the time of obtaining data from the memory.

EXAMPLE 2

Figure 9:
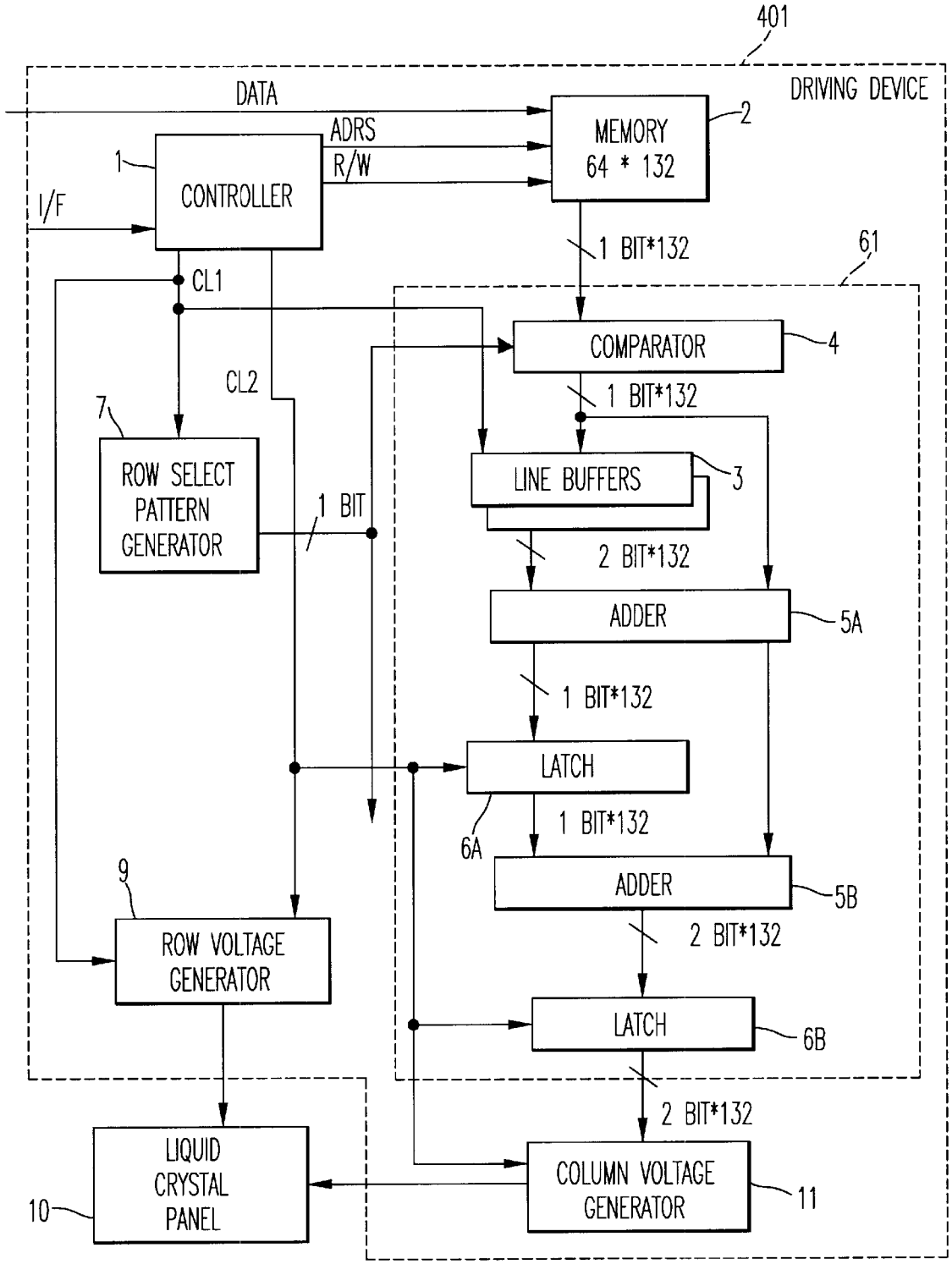
FIG. 9 is a block diagram of a driving method according to the present invention (Example 2)
Figure 10:
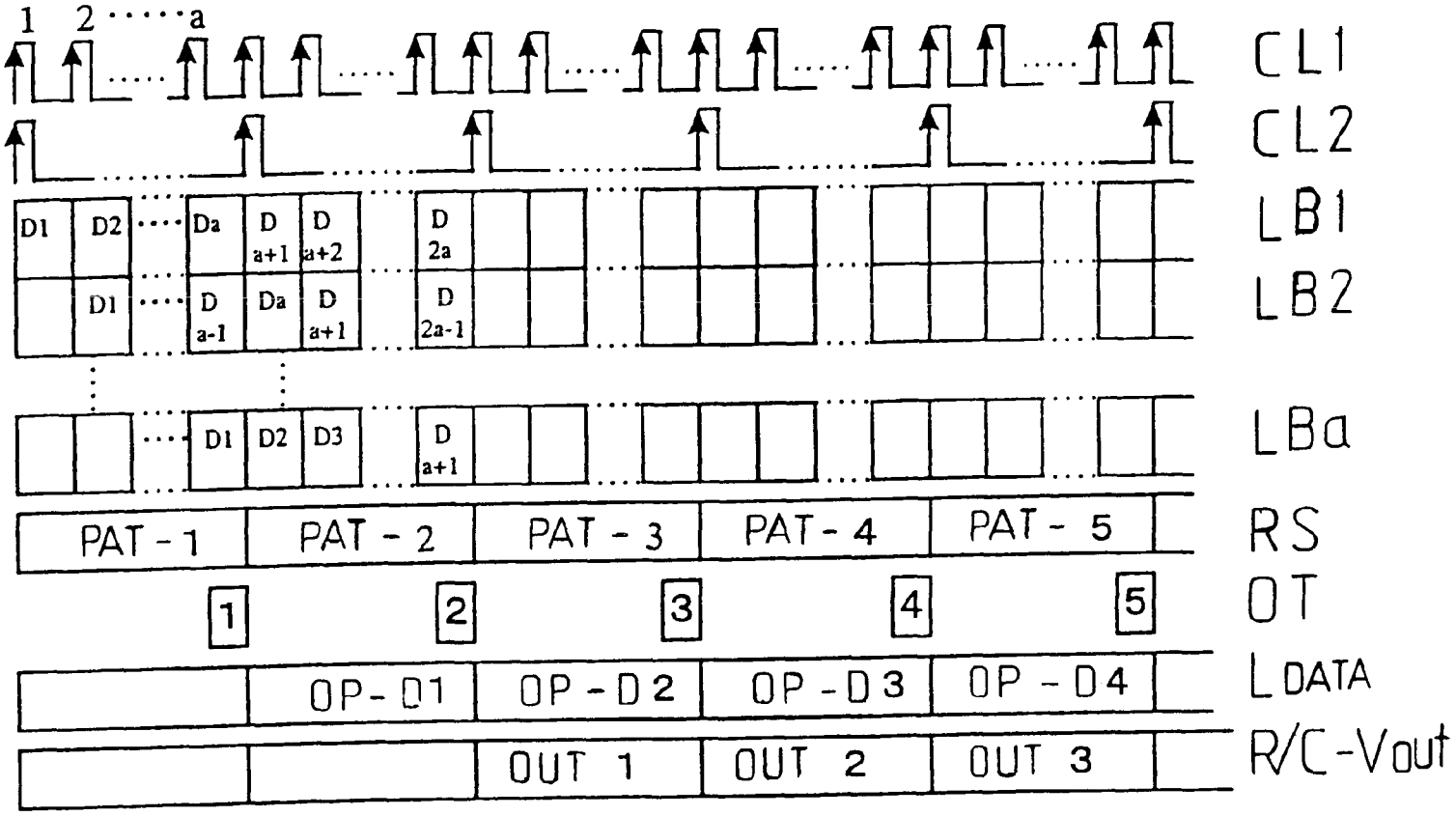
FIG. 10 PRIOR ART
FIG. 10 is a diagram of timings for explaining operations of the conventional Example 2.
Figure 11:
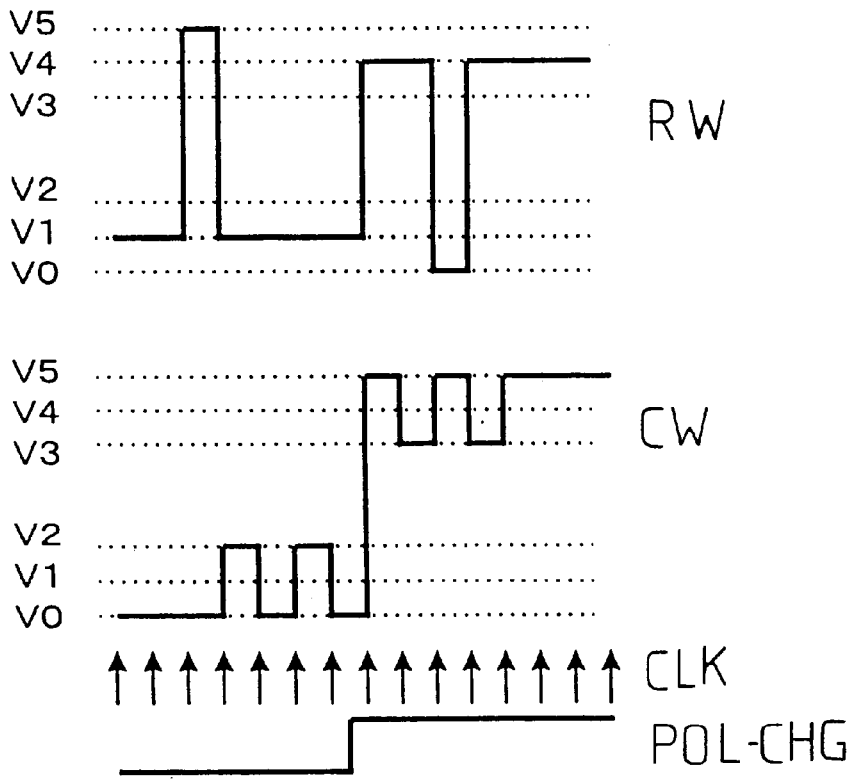
FIG. 11 PRIOR ART
FIG. 11 shows an example of driving waveforms in the conventional Example 1.

FIG. 9 is a block diagram of a driving device 401 according to this Example. In this Example, 6 simultaneously selected rows and 2 imaginary rows were employed in the same manner as in Example 1. The construction different from that of Example 1 is as follows.

Figure 14:
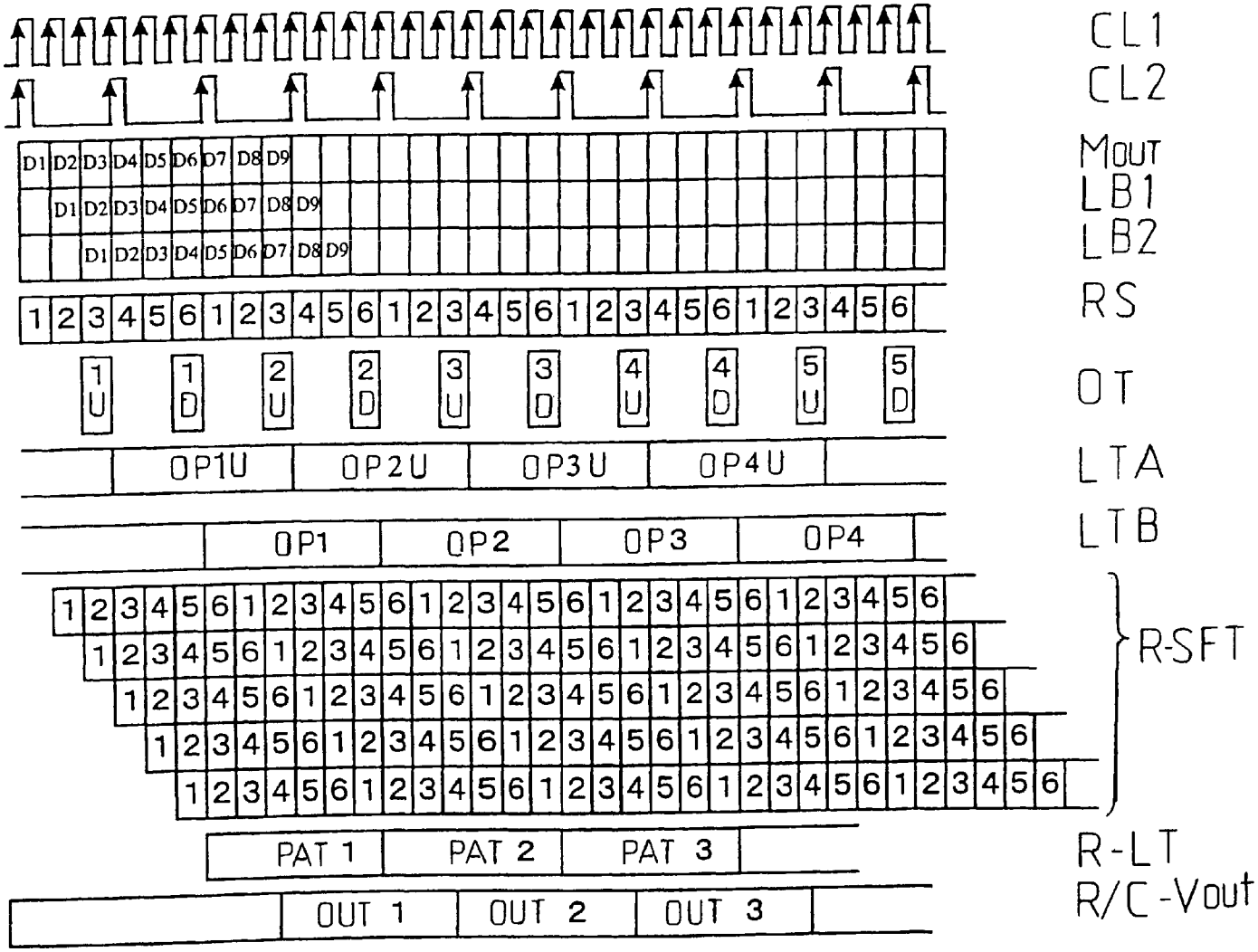
FIG. 14 is a diagram of timings for explaining operations of the present invention (Example 2)

Firstly, a signal outputted from the memory 2 is not inputted directly to the line buffer group 3, but inputted to it through the comparator circuit 4. Secondary, the imaginary data generating circuit 8 as shown in FIG. 1 is omitted. Operational timings and so on are shown in FIG. 14. The mechanism and the operations of this example will be described.

As described before, when the number of simultaneously selected rows is 6, outputted values after the operations for determining column voltages are 7 ways of "0, 1, 2, 3, 4, 5, 6", these being summarized to "2, 4, 6" by adding two imaginary data. In this Example, since the number to be selected is divided into two blocks each comprising 3 simultaneously selected rows, outputted values can be summarized to "1, 3" when a single imaginary data is added to 4 outputted values of "0, 1, 2, 3" obtainable in a case of 3 simultaneously selected number.

As outputted values which can be considered in the case of 6 in simultaneously selected number and the outputted values are summarized by adding two imaginary data when the value of an output after the operations is 2, there are two, i.e. "2" in a case that an output is unchanged due to imaginary data and "4" obtainable when +2 is added. Accordingly, output values are not primarily determined from data unless imaginary data are added.

On the other hand, a case that the number of simultaneously selected is 3 and a signal imaginary data is added, is considered. Since output values which are variable with a single imaginary data are "0" and "+1", summarization to "1" can be primarily determined in a case of 0 or 1 in an output value of the number of simultaneously selected being 3, and summarizing to "3" in a case of 2 or 3 in an output value.

Accordingly, when the simultaneously selected number is 3, the imaginary data generating circuit is unnecessary, and it is sufficient that only 2 the second bit in a lower place among outputs from the adder circuit 5A shown in FIG. 9 is taken as effective data. Further, since the imaginary data generating circuit 8 is unnecessary, there is no necessity to operate data which are once stored in the line buffer group 3 but data can be latched after they have been passed through the comparator circuit 4. Therefore, the reduction of comparator circuit is possible.

In this case, since comparing operations are conducted for each line, the row selection pattern generating circuit 7 supplies sequentially 1-bit data from an upper portion of each column of the orthogonal matrix to the comparator circuit 4 and the row voltage generating circuit 9 in synchronism with the clock CL1. The row voltage generating circuit 9 stores data for 5 rows of row selection pattern signal supplied serially from a 5-bit shift register and data for 1 row of a signal supplied directly from the row selection pattern generating circuit 7. Then, data for 6 rows in total are latched in synchronism with the clock CL2, and the latched data are outputted in synchronism with the next clock CL2 with the same timing as the column voltage generating circuit 11.

Timings of synchronized outputs are shown in FIG. 14 which shows, from an upper portion on the paper, each of the waveforms of CL1, CL2, Mout (memory output), LB1 (line buffer 1), LB2 (line buffer 2), RS (row selection signal), OT (operation period), LTA (latch A), LTB (latch B), R-SFT (row signal shift register), R-LT (row signal latch) and R/C-Vout (Row/column voltage output) sequentially.

As described in Example 1, the line buffer in the operating section can be a line buffer treating 2 lines as in this Example, if the timings can be adjusted suitably. There is a way to input an output of the comparator directly to the adder circuit 5A. The timing in this case is shown in FIG. 14.

As described above, when the feature using 3 simultaneously selected rows and 1 imaginary row is utilized well, the imaginary data generating circuit 8 can be removed. Further, since the scale of circuit in the comparator section can be ⅓ as large as Example 1, a drastic reduction in the circuit scale is possible. Further, the above-mentioned circuit structure facilitates integration into a 1-chip LS1.

For example, even in a case that a power source circuit including a booster circuit or the like and an oscillating circuit are build in, a chip size can be determined depending on the size of a pad of output due to the effect of reducing the circuit according to the present invention. Therefore, cost for manufacturing the chip is not substantially increased. Rather, manufacture can be easy because integration can be performed by utilizing a semiconductor manufacturing process for a 5-V standard logic IC, and therefore, manufacturing cost can be reduced. In the above-mentioned Examples, a square matrix is used as the matrixes A and B in which row victors perpendicularly intersect each other. However, the present invention is not limited to use such square matrix.

EXAMPLE A

Figures 5, 6:
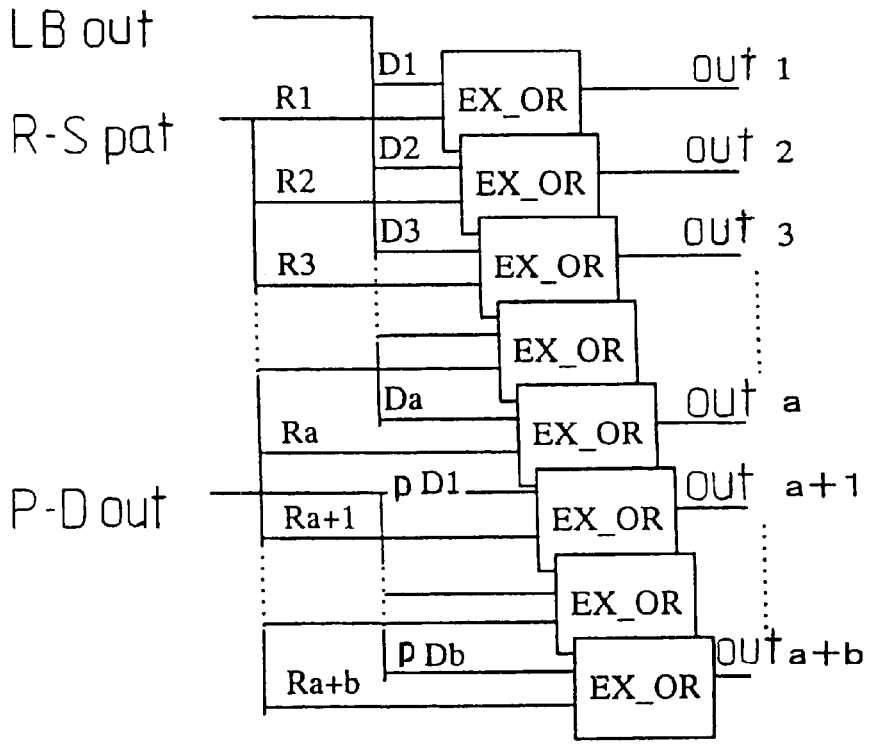
FIG. 5 PRIOR ART
FIG. 6 PRIOR ART
FIG. 5 shows a "8×8" Hadamard's matrix.
FIG. 6 shows an example of a circuit structure of a comparator for 1 column.
Figure 7:
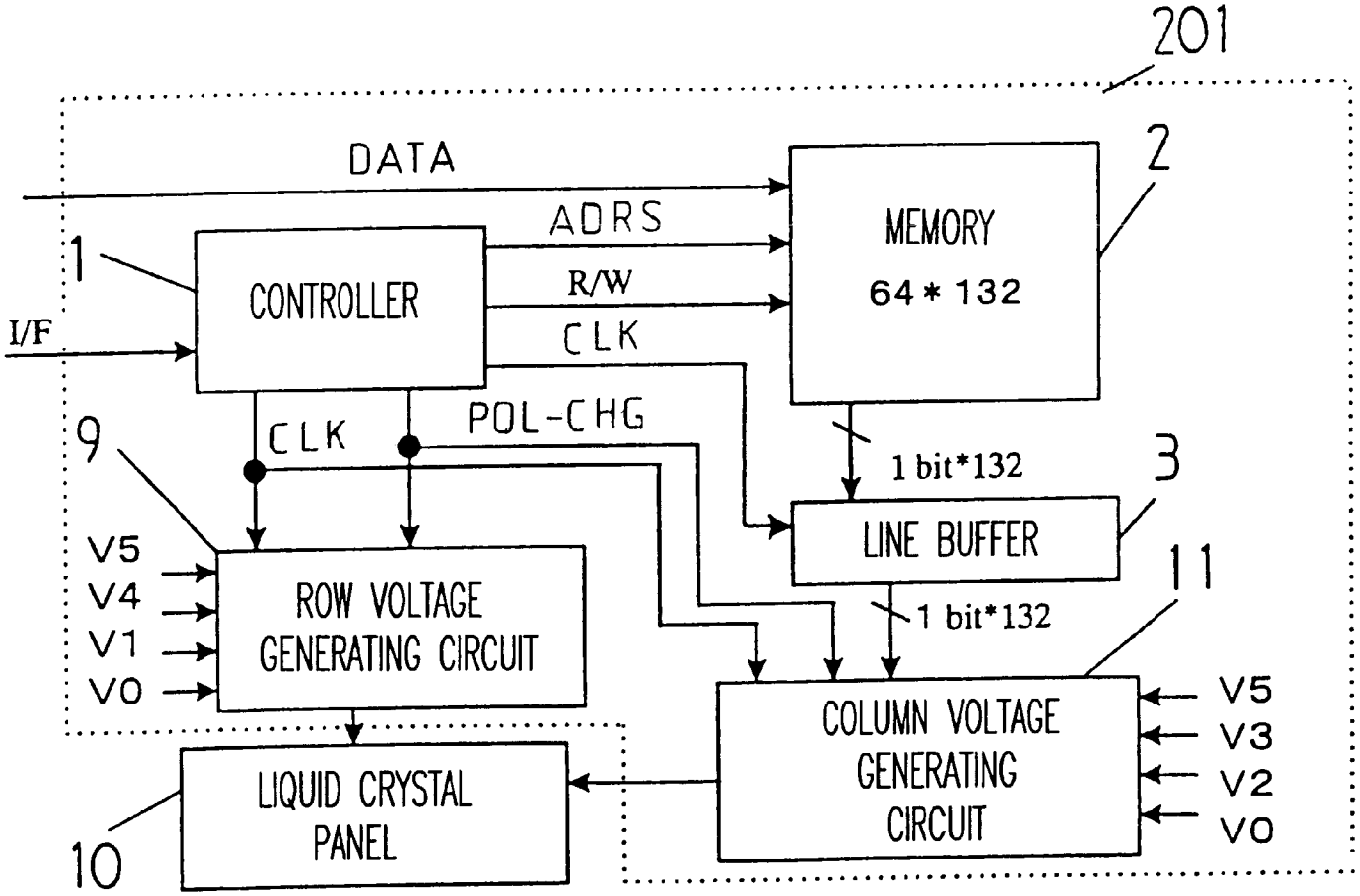
FIG. 7 PRIOR ART
FIG. 7 is a block diagram of a driving device using a conventional Example 1 (a line successive driving method)
Figure 8:
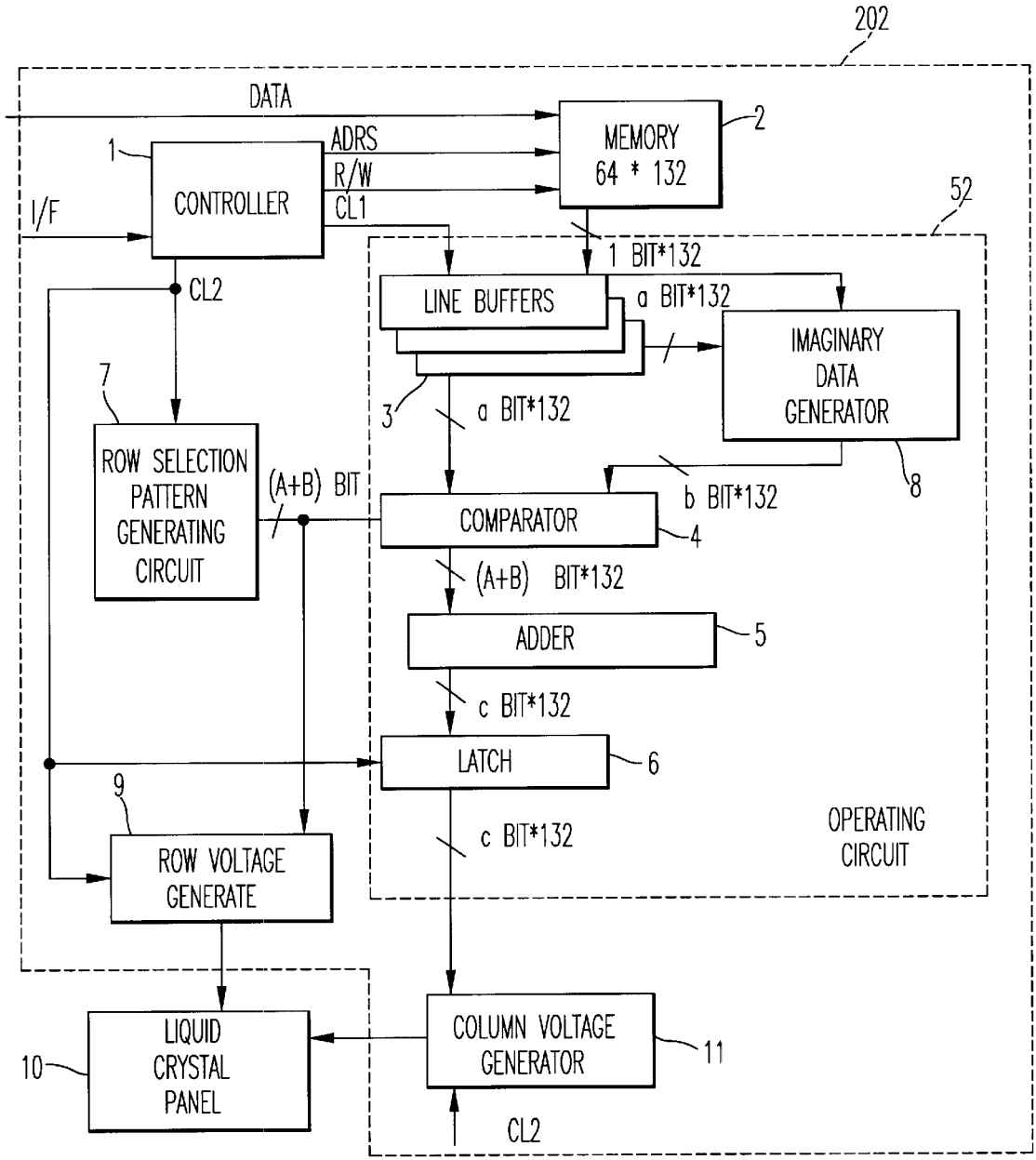
FIG. 8 PRIOR ART
FIG. 8 is a block diagram of a driving device using a convention Example 2 (MLA driving method)

A MLA driving method was used for a "64 row×132 column"-dot liquid crystal panel 10. In the MLA driving method, a "8×8" Hadamard's matrix as show in FIG. 5 was used for a row selection pattern wherein the number of simultaneously selected driven rows was 6 and the number of imaginary rows was 2, and 6 rows in an upper place were determined to be actually selected rows and 2 rows in a lower place were determined to be imaginary rows.

Figure 15:
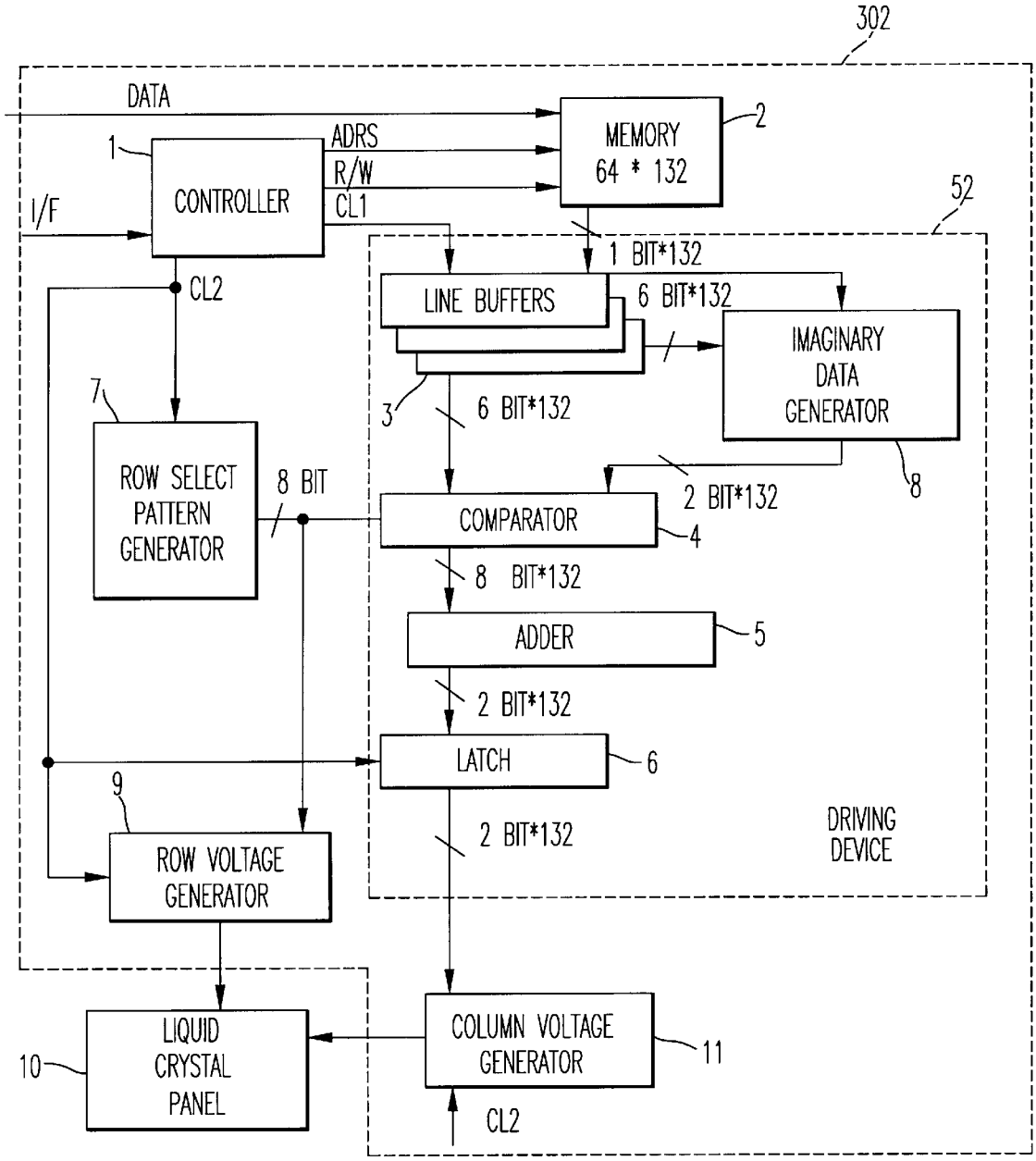
FIG. 15 is a block diagram of a driving device used for a Comparative Example (Example A).

FIG. 15 shows a block diagram of a controller-attached driving device 302. This corresponds to the MLA driving method described in Example 2 wherein a=6 and b=2. The basic operations are the same as those of the conventional example 2. Such system requires a 8×132 number of latch circuits including line buffers, a 8×132 number of comparator circuits 4, a 8-bit adder circuit 5 and a 6-bit decoder as an imaginary data generating circuit 8. Accordingly, the circuit scale was increased, and in the formation of a 1-chip IC, the surface area of the chip was larger than that determined by the size of a pad of output.

As described above, the driving device and the liquid crystal display device of the present invention can suppress an increase of the scale of the operating circuit even when a MLA driving method with imaginary rows is used. Further, it is possible to remove a data generating circuit for imaginary rows, which has conventionally been required, by using an expanded matrix with 3 simultaneously selected rows and 1 imaginary row.

As a result, even in a case of integrating into a 1-chip LSI, the chip size can be a size determined by the size of a pad while an increase of consumption current can be minimized, and the reduction in a chip cost can be achieved.

What is claimed is:

1. A driving device comprising:

an imaginary data generating means, a row electrode driving means, a column electrode driving means, a memory means for memorizing display data, an operating means for operating column output voltages, and a row selection pattern generating means for outputting a row selection pattern;

wherein:

a k·m number (k is an integer not less than 2 and m is an integer not less than 1) of simultaneously selected/driven rows and a k·n number (n is an integer of not less than 1) of imaginary row are determined for a liquid crystal display element including row electrodes and column electrodes arranged in a matrix form and the display element is driven by a multiple line addressing (MLA) driving method, and a matrix B is used for a row selection pattern, which is formed by expanding a matrix A of (m+n) rows where row vectors perpendicularly intersect each other, and column output voltages are operated in accordance with contents of the matrix A.

2. A driving device comprising:

a row electrode driving means, a column electrode driving means, a memory means for memorizing display data, an operating means for operating column output voltages, and a row selection pattern generating means for outputting a row selection pattern;

wherein:

a k·m number (k is an integer not less than 2 and m is an integer not less than 1) of simultaneously selected/driven rows and k rows of imaginary row are determined for a liquid crystal display element including row electrodes and column electrodes arranged in a matrix form and the display element is driven by a multiple line addressing (MLA) driving method, and a matrix B is used for a row selection pattern, which is formed by expanding a matrix A of (m rows+1 imaginary row) where row vectors perpendicularly intersect each other, and column output voltages are operated in accordance with contents of the matrix A.

3. The driving device according to claim 1, wherein the matrix B in which row vectors perpendicularly intersect each other is used, provided that in the below-mentioned formula (1), $p_1$, $p_2$, $p_3$ and $p_4$ are respectively 1 or −1, and $p_1 \cdot p_2 \cdot p_3 \cdot p_4 = -1$:

$$B = \begin{bmatrix} p_1 \cdot A & p_2 \cdot A \\ p_3 \cdot A & p_4 \cdot A \end{bmatrix}. \quad (1)$$

4. The driving device according to claim 2, wherein the matrix B in which row vectors perpendicularly intersect each other is used, provided that in the below-mentioned formula (1), $p_1$, $p_2$, $p_3$ and $p_4$ are respectively 1 or −1, and $p_1 \cdot p_2 \cdot p_3 \cdot p_4 = -1$:

$$B = \begin{bmatrix} p_1 \cdot A & p_2 \cdot A \\ p_3 \cdot A & p_4 \cdot A \end{bmatrix}. \quad (1)$$

5. The driving device according to claim 3, wherein a matrix C in which row vectors perpendicularly intersect each other is used, provided that in the below-mentioned formula (2), $p_5$, $p_6$, p7 and p8 are respectively 1 or −1, and $p_5 \cdot p_6 \cdot p_7 \cdot p_8 = -1$:

$$C = \begin{bmatrix} p_5 \cdot B & p_6 \cdot B \\ p_7 \cdot B & p_8 \cdot B \end{bmatrix}. \quad (2)$$

6. The driving device according to claim 4, wherein a matrix C in which row vectors perpendicularly intersect each other is used, provided that in the below-mentioned formula (2), $p_5$, $p_6$, $p_7$ and $p_8$ are respectively 1 or −1, and $p_5 \cdot p_6 \cdot p_7 \cdot p_8 = -1$:

$$C = \begin{bmatrix} p_5 \cdot B & p_6 \cdot B \\ p_7 \cdot B & p_8 \cdot B \end{bmatrix}. \quad (2)$$

7. The driving device according to claim 3, wherein the rows and/or the columns in the matrix B are exchanged.

8. The driving device according to claim 4, wherein the rows and/or the columns in the matrix B are exchanged.

9. The driving device according to claim 5, wherein the rows and/or the columns in the matrix C are exchanged.

10. The driving device according to claim 6, wherein the rows and/or the columns in the matrix C are exchanged.

11. The driving device according to claim 1, wherein the matrix A is a square matrix.

12. The driving device according to claim 2, wherein the matrix A is a square matrix.

13. The driving device according to claim 1, wherein the device is in a one-chip LSI.

14. The driving device according to claim 2, wherein the device is in a one-chip LSI.

15. The driving device according to claim 3, wherein the device is in a one-chip LSI.

16. The driving device according to claim 4, wherein the device is in a one-chip LSI.

17. The driving device according to claim 5, wherein the device is in a one-chip LSI.

18. The driving device according to claim 6, wherein the device is in a one-chip LSI.

19. A liquid crystal display device comprising the driving device described in claim 1 and a liquid crystal display element.

20. A liquid crystal display device comprising the driving device described in claim 2 and a liquid crystal display element.

* * * * *